US005820772A

United States Patent [19]

Freitag et al.

[11] Patent Number: 5,820,772

[45] Date of Patent: Oct. 13, 1998

[54] VALVELESS DIAPHRAGM PUMP FOR DISPENSING MOLTEN METAL

[75] Inventors: Otto Wilhelm Freitag, Dearborn; Randy Claude Stevenson, Saline; Keith Wade Meranda, Dearborn, all of Mich.

[73] Assignee: Ford Motor Company, Dearborn, Mich.

[21] Appl. No.: 786,562

[22] Filed: Jan. 21, 1997

[51] Int. Cl.[6] ..... B67D 1/10

[52] U.S. Cl. ..... 222/595; 222/591

[58] Field of Search ..... 222/590, 591, 222/594, 595, 420, 213

[56] References Cited

U.S. PATENT DOCUMENTS

| | | | |
|---|---|---|---|
| 4,030,640 | 6/1977 | Citrin et al. | 222/213 |
| 4,779,790 | 10/1988 | Wallgren et al. | 228/180.1 |
| 5,229,016 | 7/1993 | Hayes et al. | 222/590 |
| 5,320,250 | 6/1994 | La et al. | 222/420 |
| 5,320,273 | 6/1994 | Goenka et al. | 228/33 |
| 5,364,011 | 11/1994 | Baker et al. | 228/180.21 |
| 5,529,465 | 6/1996 | Zengerle et al. | 417/413.2 |
| 5,554,412 | 9/1996 | Lymn | 427/96 |
| 5,560,537 | 10/1996 | Sadler et al. | 228/102 |
| 5,560,543 | 10/1996 | Smith et al. | 239/102.2 |

*Primary Examiner*—Scott Kastler
*Attorney, Agent, or Firm*—Leslie C. Hodges; Roger L. May

[57] ABSTRACT

A solder pump includes a pump body having a solder reservoir and pump chamber formed therein in fluid communication with each other. A nozzle portion is provided in communication with the pump chamber for dispensing solder. A thin movable diaphragm is positioned adjacent the pump chamber and movable into the pump chamber for selectively pressurizing solder in the pump chamber for dispensing solder through the nozzle portion. A diaphragm clamp is secured to the body for supporting the diaphragm. The clamp includes an internal channel extending therein and enclosed by the diaphragm. The channel is provided in communication with a source of pressurized air for selectively forcing the diaphragm into the pump chamber. An adjustable stop is positioned within the pump chamber adjacent the diaphragm for limiting movement of the diaphragm into the pump chamber.

13 Claims, 6 Drawing Sheets

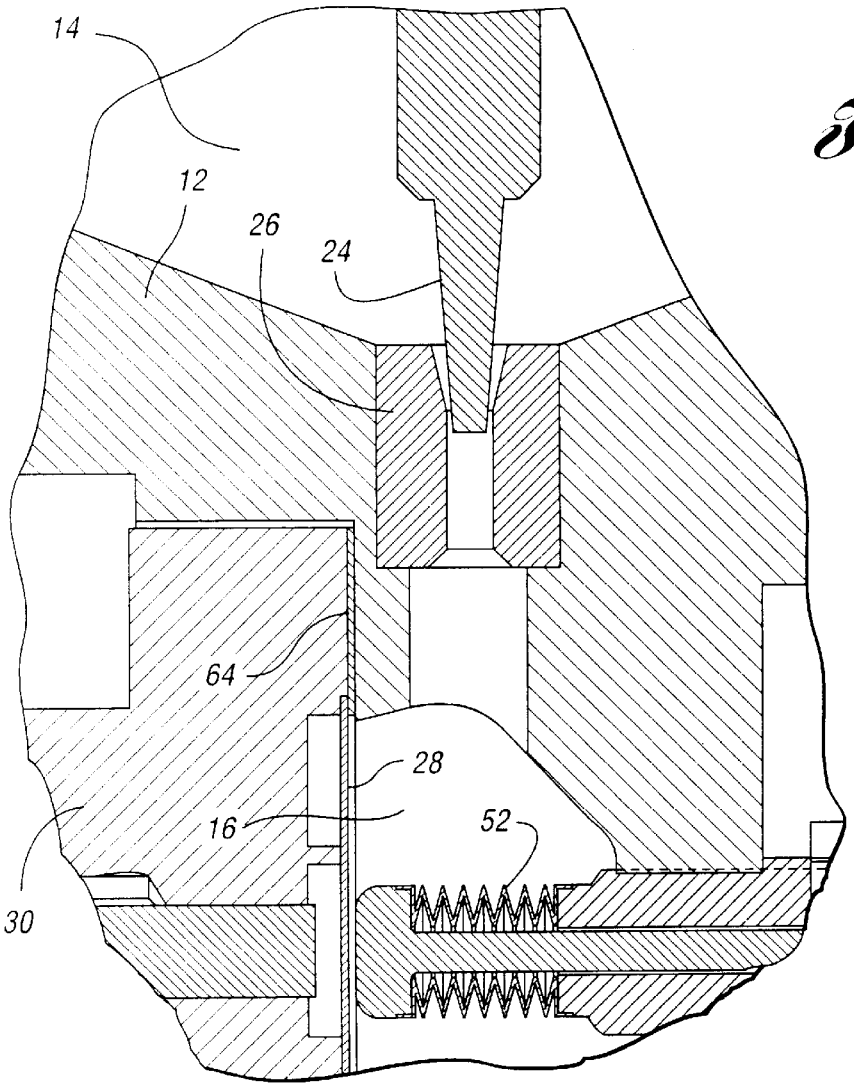
Fig. 4
Fig. 6
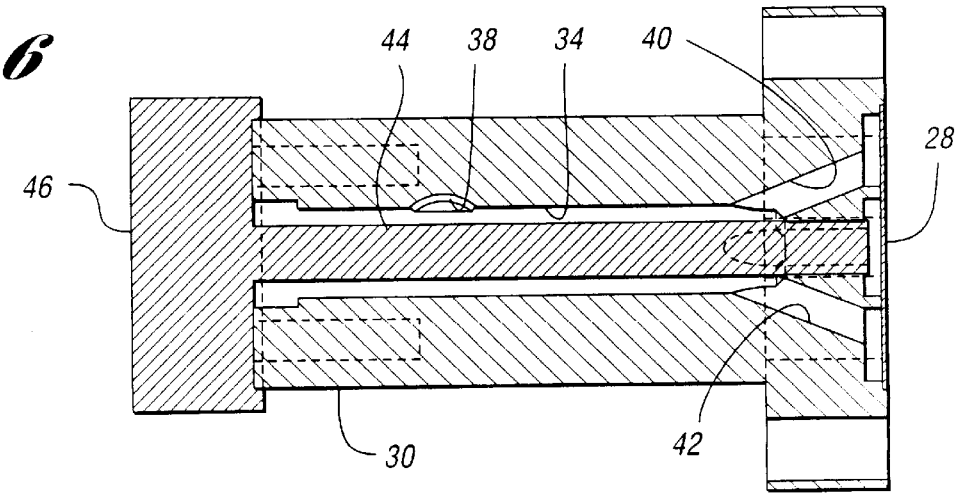

VALVELESS DIAPHRAGM PUMP FOR DISPENSING MOLTEN METAL

TECHNICAL FIELD

The present invention relates to molten metal pumps, and more particularly to a valveless diaphragm pump for dispensing molten metal.

BACKGROUND OF THE INVENTION

When soldering operations or other metal dispensing processes require application of microliter volumes of solder to a workpiece, wave soldering or reflow soldering processes are typically used. These processes are generally very capital-intensive, as they require expensive soldering equipment and narrow process design windows for component positioning and soldering. Additionally, the processes require fluxing, preheating, and postheating processes before soldering, which adds time and expense to the manufacturing process.

Solder-dispensing pumps and other attempts to circumvent such processes have been limited. Because solder becomes molten at approximately 200° C., a solder-dispensing pump would be required to dispense the solder at minimally 250° C. However, at this temperature, thermal expansion mismatches in the pump body, heat destruction of rubber seals in pump valves, and the need to control a very small (microliter) solder volume, have together discouraged the use of pump-type dispensers.

U.S. Pat. No. 5,364,011 discloses an effort to provide a pneumatically controlled dispenser with the option for a diaphragm driver for dispensing solder; however, this apparatus is limited in that the solder cannot be dispensed in a controlled manner because of difficulty in cutting off the flow of solder from the nozzles.

DISCLOSURE OF THE INVENTION

The present invention overcomes the above referenced shortcomings of prior art methods and assemblies by providing a valveless molten metal pump with a movable diaphragm having an adjustable stop and a throttle. The volume flow rate, total volume and internal pressure can be adjusted to give the desired dispense. The time dependence of the pressure waveform driving the diaphragm, the position of the diaphragm stop, and most importantly, the throttling of flow to the solder reservoir, all contribute to the dispense of single drops in a controlled manner. By eliminating the pump valves and using all titanium components, the diaphragm pump of the present invention may be used at temperatures above 250° C., and may not require a fluxing process prior to soldering, and may also require less expensive equipment than the wave soldering or reflow soldering processes, because of the select dispense of the solder. By eliminating the standard wave or reflow soldering processes, the substrate or workpiece need not be immersed in solder or high temperature ovens, and therefore the present invention enables use of substrates with lower melting temperatures and lesser structural integrity.

More specifically, the present invention provides a solder pump, comprising a pump body having a solder reservoir and pump chamber formed therein in fluid communication with each other. A nozzle portion is provided in communication with the pump chamber for dispensing solder. A thin movable diaphragm is positioned adjacent the pump chamber and movable into the pump chamber for selectively pressurizing solder in the pump chamber for dispensing solder through the nozzle portion. A diaphragm clamp is secured to the body for supporting the diaphragm. The clamp includes an internal channel extending therein and enclosed by the diaphragm. The channel is provided in communication with a source of pressurized air for selectively forcing the diaphragm into the pump chamber. An adjustable stop is positioned within the pump chamber adjacent the diaphragm for limiting movement of the diaphragm into the pump chamber.

Accordingly, an object of the present invention is to provide a valveless pump for dispensing molten metal that dispenses in a repeatable controlled manner, and is operable at temperatures at or above 250° C.

The above object and other objects, features, and advantages of the present invention are readily apparent from the following detailed description of the best mode for carrying out the invention when taken in connection with the accompanying drawings.

BRIEF DESCRIPTION OF THE DRAWINGS

FIG. 4 shows an enlarged sectional view taken from detail 4 of FIG. 3;

FIG. 6 shows a vertical cross-sectional view of a diaphragm clamp and diaphragm in accordance with the present invention.

DETAILED DESCRIPTION OF THE PREFERRED EMBODIMENT

Figure 1:
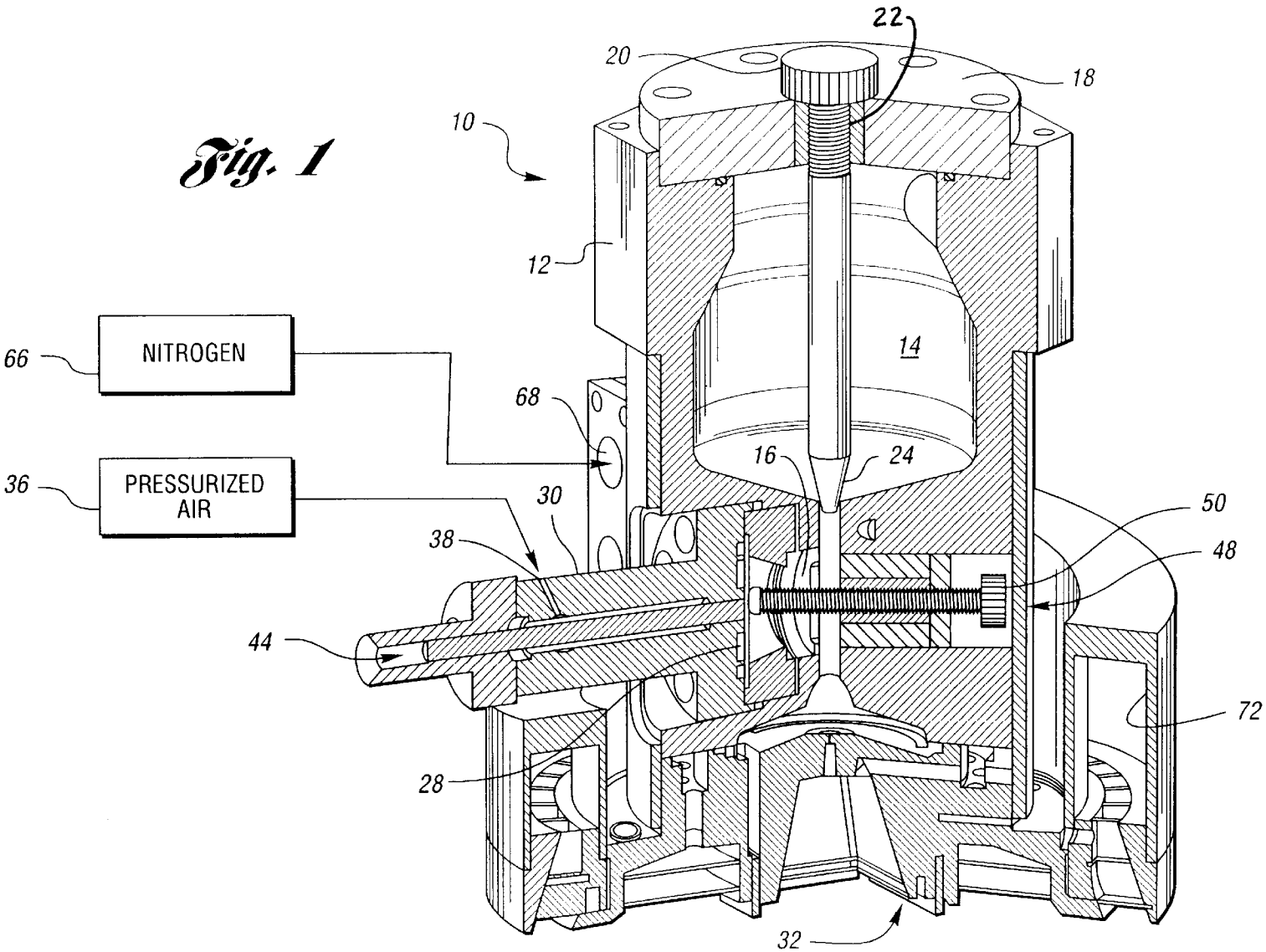
FIG. 1 shows a schematically arranged, partially cut-away perspective view of a solder pump in accordance with the present invention.
Figure 2:
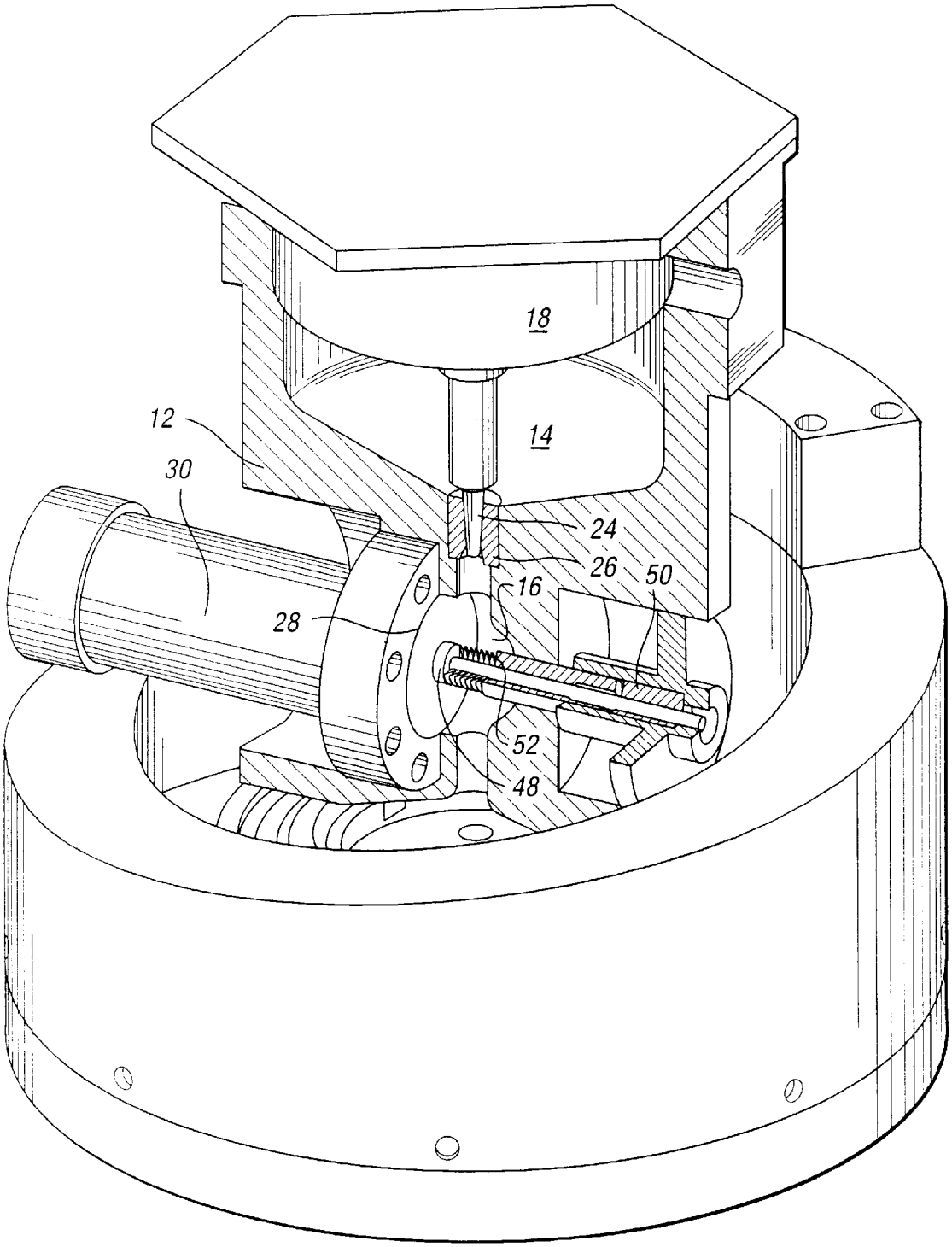
FIG. 2 shows a partially cut-away perspective view of a solder pump in accordance with the present invention.

Referring to FIG. 1, a schematically arranged, cut-away perspective view of a solder pump assembly 10 is shown in accordance with the present invention. The solder pump assembly 10 includes a pump body 12 having a solder reservoir 14 and pump chamber 16 formed therein in fluid communication with each other, as most clearly seen in FIG. 2. The pump body 12 includes a top portion 18 secured thereon for enclosing the reservoir 14.

An adjustable throttle 20 is threaded to the top portion 18 at the threads 22 for adjustment thereof, and includes a tip portion 24 which cooperates with an internal channel formed in the throttle cylinder 26 for selectively throttling flow of fluid between the reservoir 14 and pump chamber 16, as more clearly shown in FIG. 4.

The pump chamber 16 is bounded at one side with a thin movable diaphragm 28. The diaphragm 28 is supported by a diaphragm clamp 30. The movable diaphragm 28 is positioned adjacent the pump chamber 16 and movable into the pump chamber 16 for selectively driving solder in the pump chamber 16 for dispensing solder through the nozzle portion 32 of the pump assembly.

As shown in FIG. 6, the diaphragm clamp 30 includes an internal channel 34 extending therein and enclosed by the diaphragm 28. As shown in FIG. 1, the channel 34 is provided in communication with a source of pressurized air 36 through the side channel 38 of the clamp 30. The source of pressurized air is therefore operative to force the diaphragm 28 into the pump chamber 16.

Accordingly, to pump solder volumes on the order of 10 micro-liters (10 cubic millimeters), the center of the thin diaphragm 28, which is approximately 0.008 inch in diameter, is displaced on the order of 0.001 to 0.005 inches by pulses of pressurized air received from the pressurized air source 36. The air travels through the side channel 38 to the internal channel 34 of the clamp 30, and along the plurality of angular channels 40,42 formed in the clamp 30 for directing the pressurized air against the diaphragm 28 for causing such displacement. Displacement of the diaphragm 28 is measured by the optical probe 44 for controlling such displacement. The optical probe 44 includes a probe rear portion 46 which encloses the rear end of the internal channel 34 of the clamp 30.

Movement of the diaphragm 28 into the pump chamber 16 is limited by the adjustable stop 48. The adjustable stop 48 includes a rotatable knob 50 which provides means for adjusting the positioning of the adjustable stop 48 with respect to the diaphragm 28 as a result of the threaded connection between the adjustable stop 48 and its support portion 50, shown in FIG. 2. The adjustable stop 48 also includes a flexible bellows 52 which prevents leakage of the solder along the adjustable stop 48.

Figure 3:
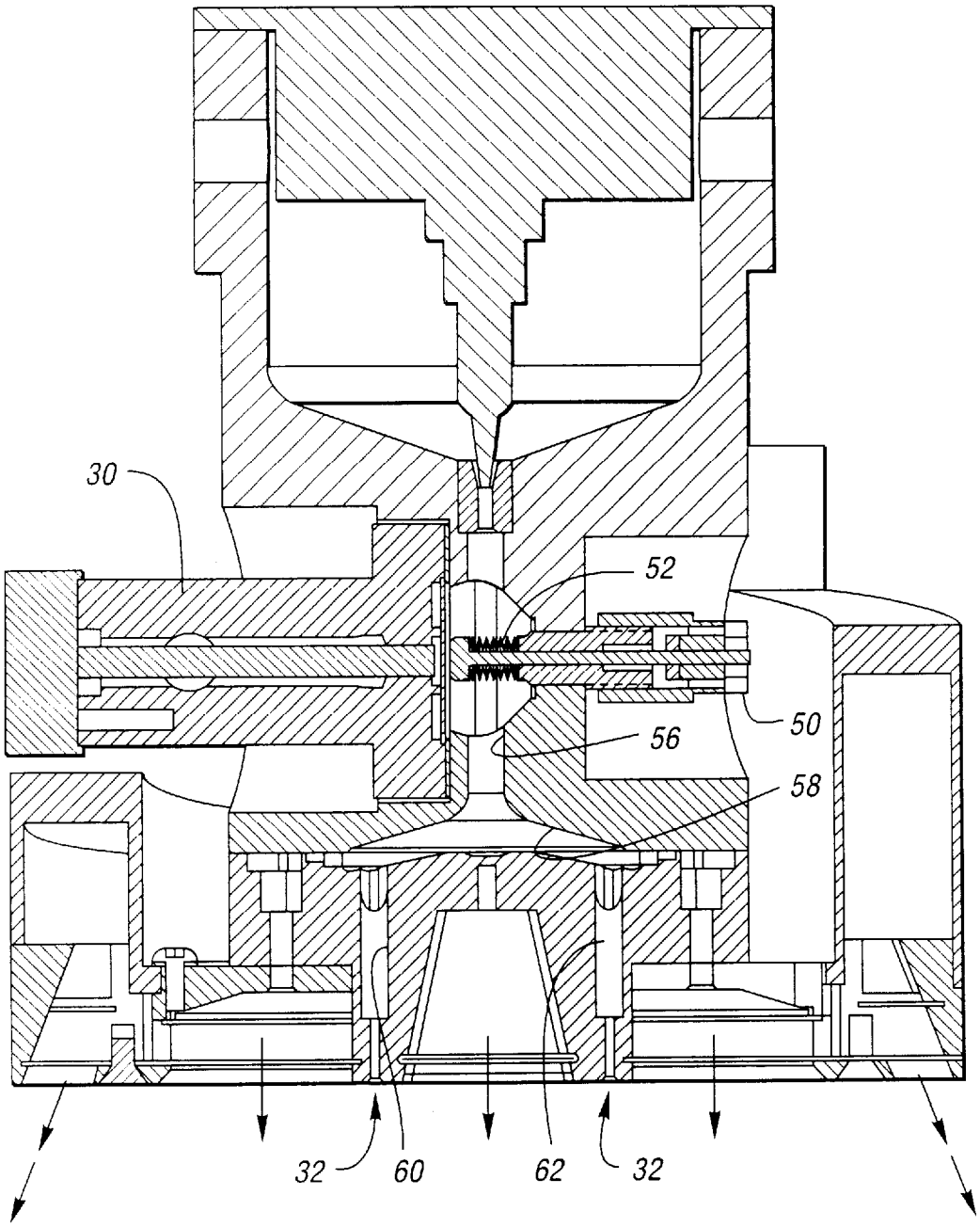
FIG. 3 shows a vertical cross-sectional view of a solder pump in accordance with the present invention.

Accordingly, when the movable diaphragm 28 moves into the pump chamber 16, thereby pressuring the solder, the solder moves along the channels 56, 58, 60, 62, as shown in FIG. 3, toward the nozzle portion 32 for dispensing the solder. The movable diaphragm 28 moves until it contacts the adjustable stop 48, which causes an abrupt stop to the diaphragm motion, which then contributes to a sharp cut off of flow in the nozzles 32. The momentum of solder moving upward past the adjustable throttle 20 helps to limit the flow of molten solder to the nozzle portion 32, shown in FIG. 3. The time of travel for the central displacement of the thin diaphragm 28 is on the order of several milliseconds. The flow of solder upward toward the reservoir 14 is mitigated by the adjustable throttle 20 that allows adjustment of the pressure build-up within the pump chamber 16 independently of the pressure of the air applied to the diaphragm 28. The diaphragm retraction also refills the pump with a new charge of solder.

Accordingly, the volume of solder dispensed is controlled by four factors: 1) the pressure impulse applied to the diaphragm 28; 2) the allowed diaphragm displacement; 3) the throttle position; and 4) the geometry of the nozzle portion 32. The velocity of the dispensed solder is also controlled by these parameters. With these parameter controls, one is able to dispense single large drops simultaneously from each nozzle, with no small satellite drops that may lead to shorts across leads of devices to be soldered.

The assembly comprises an all titanium construction in that all components of the pump that contact solder are composed of titanium. This construction ensures that most commercially-significant solders will not wet the pump components, i.e. create a metallurgical reaction therewith. In addition, thermal expansion mismatches are minimized when the pump temperature is elevated, for example, from room temperature to 250° C., for tin-lead solders.

Additionally, seals, such as seal 64 shown in 64, are all metal. Rubber seals would fail at temperatures in the neighborhood of 250° C. These metal seals are effective beyond 250° C. Flat titanium or soft aluminum gasket seals are preferred. In the titanium gasket scheme, the gaskets are compressed about 2 mils between sealing surfaces that have been hardened with a CrN coating. This method provides a very high temperature liquid seal.

The diaphragm 28 is preferably composed of a grade 5 titanium, which has excellent fatigue resistant thermal cycling characteristics. The construction of these thin diaphragms is made repeatable by cutting disks from thin sheets (typically 5–10 mils thick) of titanium. The diaphragm's elastic characteristics are quite sensitive to the diaphragm thickness and diameter. The thickness control obtained through the use of rolled titanium sheets appears to be better than that obtained by trying to conventionally machine the diaphragms. The disks are then E-beam or laser-welded to titanium stands at the top about the periphery of the diaphragm 28.

The diaphragm 28, as mentioned above, is driven by a source of pressurized air 36, which delivers short air pulses controlled by a simple circuit that sends electric pulses to open or close a pair of solenoids associated with a gate valve. The use of air pulses has the advantage of being relatively insensitive to high temperatures as compared to other possible drives, such as ceramic piezoelectric plates. The rise times in the diaphragm are controlled by the rise time and amplitude of the pressure impulse and the displacement allowed by the diaphragm stop 48. In this configuration, the pump is able to dispense single drops of solder on command. The size of the drops is controlled in large part by the diameter of the nozzles.

Figure 5:
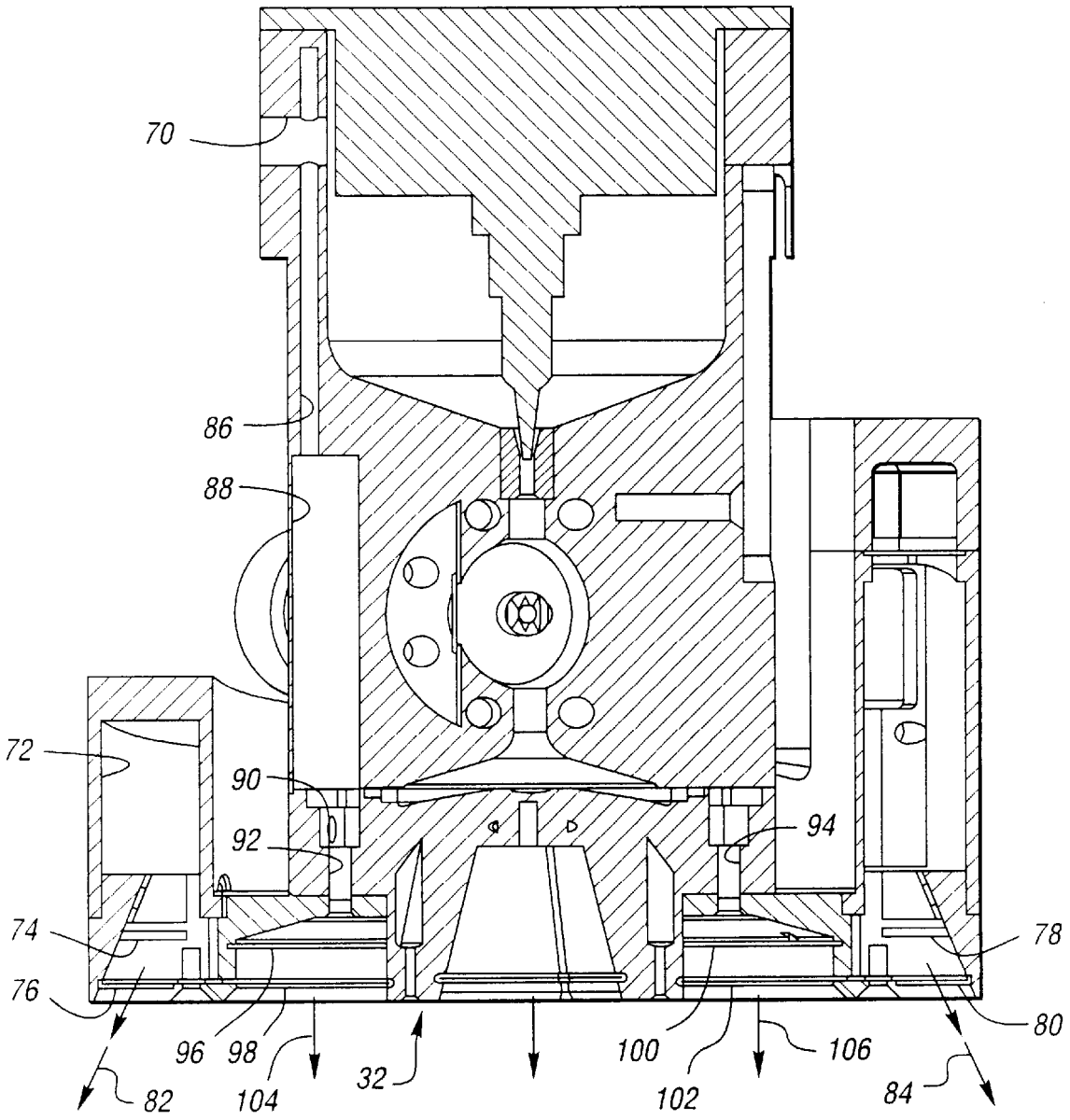
FIG. 5 shows a vertical cross-sectional view of a solder pump in accordance with the present invention.

The pump assembly 10 is also provided with an internal inerting system. The inerting system is integral to the pump body 12. As shown in FIGS. 1 and 5, a source of pressurized nitrogen 66 enters through the port 68 of FIG. 1 and through port 70 of FIG. 5 for entry into the inerting system. The nitrogen entering port 68, shown in FIG. 1, enters the helical channel 72 and passes through the diffusion screens 74, 76, 78, 80 and is directed outwardly in the direction indicated by arrows 82,84 in FIG. 5 to form a substantially cone-shaped flow of nitrogen around the nozzle portion 32 which creates a wall of nitrogen which acts to inert the dispensing area. A separate, second, inerting flow of nitrogen enters the port 70 shown in FIG. 5, travels through the side channels 86,88 and is then distributed by means of the disk-shaped channel 90 to flow channels 92,94, through the diffusion screens 96, 98, 100, 102 and downward adjacent the nozzle portion 32 in the direction of the arrows 104,106.

Figure 7:
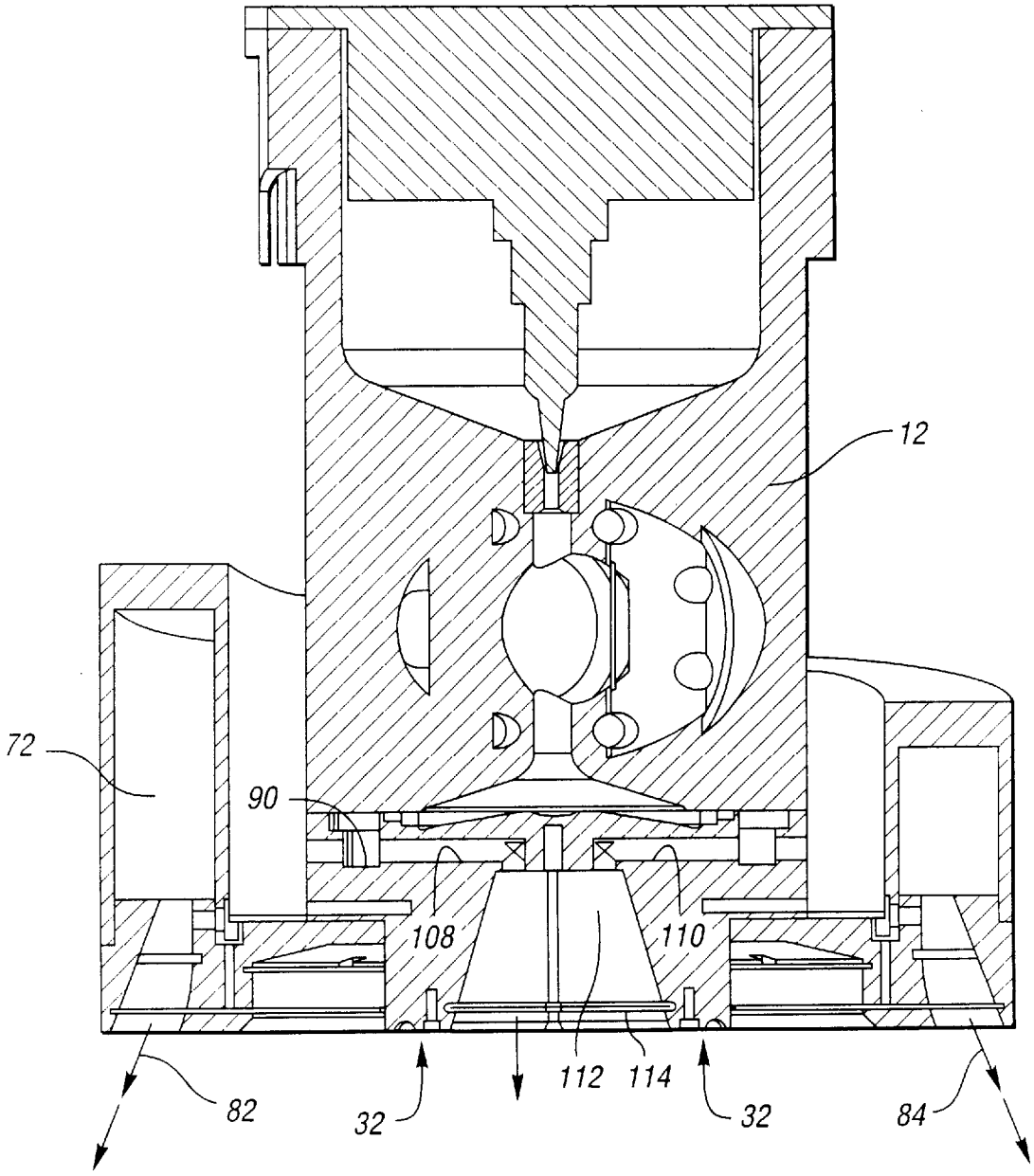
FIG. 7 shows a vertical cross-sectional view of the solder pump in accordance with the present invention.

As shown in FIG. 7, nitrogen from the disk-shaped channel 90 also travels radially inward through the radial channels 108,110 and into the central channel 112, through the diffusion screen 114, and downward between the nozzle portions 32. By using streams of nitrogen gas, this inerting system will reduce oxygen levels down to or below 10 ppm (parts per million) of oxygen when the pump head is maintained at a height of ¼ inch from the substrate of the components to be soldered. Also, this inerting system minimizes windage forces that would negatively affect the trajectory of the micro-size solder drops as they fall to the substrate. The surface tension of the solder increases dramatically when exposed to oxygen, so the inerting process is important to pump operation. The molten solder will not detach itself consistently from the nozzle during a dispense cycle if high surface tension exists. In addition, the internal inerting system provides ease of operation of the pump because the pump may be operated in an open environment, i.e. no special enclosures are required as long as the pump is held at the ¼ to ½ inch vertical distance from the workpiece.

While the best mode for carrying out the invention has been described in detail, those familiar with the art to which this invention relates will recognize various alternative designs and embodiments for practicing the invention within the scope of the appended claims.

What is claimed is:

1. A solder pump, comprising:

a pump body having a solder reservoir and pump chamber formed therein in fluid communication with each other;

a nozzle portion in communication with said pump chamber for dispensing solder;

a thin movable diaphragm positioned adjacent the pump chamber and movable into the pump chamber for selectively pressurizing solder in the pump chamber for dispensing solder through the nozzle portion;

a source of pressurized air provided in communication with the pump for selectively forcing the diaphragm into the pump chamber; and an adjustable stop positioned within the pump chamber adjacent the diaphragm for limiting movement of the diaphragm into the pump chamber.

2. The solder pump of claim 1, further comprising an adjustable throttle positioned between said solder reservoir and pump chamber for selectively restricting fluid flow therebetween.

3. The solder pump of claim 1, further comprising:

a diaphragm clamp secured to the body for supporting the diaphragm, said clamp having an internal channel extending therein and enclosed by the diaphragm, said channel being in communication with said source of pressurized air; and an optical probe disposed within the internal channel of the clamp for sensing diaphragm displacement.

4. The solder pump of claim 1, wherein said diaphragm comprises a titanium sheet between 5 and 10 mils thick.

5. The solder pump of claim 1, wherein said pump does not include any solder flow valves.

6. The solder pump of claim 1, wherein all pump components arranged to contact solder within the pump comprise titanium to facilitate consistent thermal expansion to facilitate pump operation above 250° C.

7. A molten metal pump, comprising:

a pump body having a molten metal reservoir and pump chamber formed therein in fluid communication with each other;

a nozzle portion in communication with said pump chamber for dispensing molten metal;

a thin movable diaphragm positioned adjacent the pump chamber and movable into the pump chamber for selectively pressurizing the molten metal in the pump chamber for dispensing molten metal through the nozzle portion;

a diaphragm clamp secured to the body for supporting the diaphragm, said clamp having an internal channel extending therein and enclosed by the diaphragm, said channel body being provided in communication with a source of pressurized air for selectively forcing the diaphragm into the pump chamber; and an adjustable throttle positioned between said molten metal reservoir and pump chamber for selectively restricting fluid flow therebetween, wherein the throttle facilitates dispensing of single drops in a controlled manner.

8. The molten metal pump of claim 7, further comprising an adjustable stop positioned within the pump chamber adjacent the diaphragm for limiting movement of the diaphragm into the pump chamber.

9. The molten metal pump of claim 8, further comprising an optical probe disposed within the internal channel of the clamp for sensing diaphragm displacement.

10. The molten metal pump of claim 8, wherein said diaphragm comprises a titanium sheet between 5 and 10 mils thick.

11. The molten metal pump of claim 8, wherein said pump does not include any solder flow valves.

12. The molten metal pump of claim 8, wherein all pump components arranged to contact solder within the pump comprise titanium to facilitate consistent thermal expansion to facilitate pump operation above 250° C.

13. A solder pump, comprising:

a pump body having a solder reservoir and pump chamber formed therein in fluid communication with each other;

a nozzle portion in communication with said pump chamber for dispensing solder;

a thin movable diaphragm positioned adjacent the pump chamber and movable into the pump chamber for selectively pressurizing solder in the pump chamber for dispensing solder through the nozzle portion;

a diaphragm clamp secured to the body for supporting the diaphragm, said clamp having an internal channel extending therein and enclosed by the diaphragm, said channel being provided in communication with a source of pressurized air for selectively forcing the diaphragm into the pump chamber;

an adjustable stop positioned within the pump chamber adjacent the diaphragm for limiting movement of the diaphragm into the pump chamber; and an adjustable throttle positioned between the solder reservoir and pump chamber for selectively restricting fluid flow therebetween.

* * * * *